United States Patent [19]

Klenk

[11] Patent Number: 5,065,726

[45] Date of Patent: Nov. 19, 1991

[54] LEARNING CONTROL METHOD FOR AN INTERNAL COMBUSTION ENGINE AND APPARATUS THEREFOR

[75] Inventor: Martin Klenk, Backnang, Fed. Rep. of Germany

[73] Assignee: Robert Bosch GmbH, Stuttgart, Fed. Rep. of Germany

[21] Appl. No.: 585,104

[22] PCT Filed: Mar. 4, 1989

[86] PCT No.: PCT/DE89/00135

§ 371 Date: Oct. 2, 1990

§ 102(e) Date: Oct. 2, 1990

[87] PCT Pub. No.: WO89/09334

PCT Pub. Date: Oct. 5, 1989

[30] Foreign Application Priority Data

Apr. 2, 1988 [DE] Fed. Rep. of Germany ..... 3811262

[51] Int. Cl.[5] ..... F02D 41/14; F02D 41/24

[52] U.S. Cl. ..... 123/480; 123/486; 123/489

[58] Field of Search ..... 123/440, 478, 480, 486, 123/488, 489

[56] References Cited

U.S. PATENT DOCUMENTS

| | | | |
|---|---|---|---|
| 4,530,333 | 7/1985 | Nishimura | 123/480 X |
| 4,566,420 | 1/1986 | Sakamoto et al. | 123/480 X |
| 4,625,699 | 12/1986 | Kobayashi et al. | 123/489 |
| 4,646,697 | 3/1987 | Grob et al. | 123/440 X |
| 4,768,490 | 9/1988 | Heck et al. | 123/489 |
| 4,827,937 | 5/1989 | Kohler et al. | 123/486 |
| 4,884,547 | 12/1989 | Tamura | 123/488 X |
| 4,901,240 | 2/1990 | Schmidt et al. | 123/440 X |
| 4,932,376 | 6/1990 | Linder et al. | 123/486 X |
| 4,977,881 | 12/1990 | Abe et al. | 123/486 X |
| 4,987,890 | 1/1991 | Nagaishi | 123/480 X |

FOREIGN PATENT DOCUMENTS

| | | |
|---|---|---|
| 0221386 | 5/1987 | European Pat. Off. . |
| 0275507 | 7/1988 | European Pat. Off. . |
| 3505965 | 8/1986 | Fed. Rep. of Germany . |

*Primary Examiner*—Willis R. Wolfe
*Attorney, Agent, or Firm*—Walter Ottesen

[57] ABSTRACT

A method for learning control and precontrol for adjusting the lambda value for the air/fuel mixture to be metered to an internal combustion engine 11 compares a large comparison value with a small comparison value with the large comparison value being formed by averaging of adaptation factors for large precontrol values and the small comparison value being formed by averaging of adaptation factors for small precontrol values. Whenever the large comparison value is smaller than the small comparison value, a global summand is incremented by a correction value, otherwise it is decremented. An apparatus operating according to this method has the advantage that disturbing influences which act additively on the injection time are compensated with great accuracy.

5 Claims, 2 Drawing Sheets

LEARNING CONTROL METHOD FOR AN INTERNAL COMBUSTION ENGINE AND APPARATUS THEREFOR

FIELD OF THE INVENTION

The invention relates to a learning control method with precontrol for adjusting the lambda value for the air/fuel mixture to be supplied to an internal combustion engine. The invention also relates to an apparatus for carrying out such a method.

BACKGROUND OF THE INVENTION

Such a method and an associated apparatus are known from U.S. Pat. No. 4,827,937. The apparatus has a precontrol means, a desired-value generator means, a control means and an adaptation factor memory. The process serves, for example, for adjusting the injection time. The precontrol means outputs a precontrol value for the injection time dependent upon values of other operating variables than the injection time. The desired-value generator means supplies a single controlled variable desired value, namely the lambda value 1. This value is compared with the respective lambda actual value, which is measured by a lambda probe. The control means forms a control output, namely a control factor, dependent upon the difference between the two values and the respective precontrol value is corrected with the control factor in a closed-loop manner by multiplication. However, the precontrol value is also corrected under open-loop control, that is with the aid of an adaptation factor read out from the adaptation factor memory. The adaptation factor memory stores adaptation values which are addressable via values of addressing operating variables. For correcting the precontrol value, the memory reads out the adaptation factor which belongs to the set of values of the addressing operating variables existing in that particular case. The precontrol value is multiplicatively combined with this factor. The adaptation factors are always redetermined with the aid of the control factor supplied by the control means. At predetermined longer time intervals, the factors of the adaptation factor memory are evaluated to the extent that the average value of all the factors is formed and this average value is incorporated in a so-called multiplicative global factor. This value then globally takes into account corrections which are necessary both due to disturbing influences acting multiplicatively on the injection time as well as disturbing influences acting additively.

Additively acting disturbing influences are better taken into account in a method such as that known from SAE paper number 860594, 1986, likewise for adjusting the injection time. Apart from the above-mentioned function stages, the associated apparatus also has a summand-determining means, which determines a summand which is added to the precontrol value corrected by multiplicative factors. The summand is measured in idling, that is with small injection times. This is due to the consideration that, with small injection times, a multiplicatively acting disturbing influence has a relatively weak effect, but an additively acting disturbing influence has a relatively strong effect.

The system just mentioned has the following disadvantage. The case may readily occur where, even with small injection times, an additively acting disturbing influence compensates itself with an opposing multiplicatively acting disturbing influence. Then, the precontrolled time is not corrected additively (and opposingly multiplicatively), although this actually would be necessary. This error, which originates from the determination in idling, has an effect in the entire load and speed range of the internal combustion engine.

The invention is based on the object of specifying a method for learning control with precontrol for adjusting the lambda value which takes better into account disturbing influences which act additively on the metering of the quantity of fuel than known methods. The invention is also based on the object of specifying an apparatus for carrying out such a method.

SUMMARY OF THE INVENTION

The apparatus according to the invention for the means described, that is a precontrol means, a desired-value generator means, a control means, an adaptation factor memory and a summand-determination means. In addition, it has a comparator means and a change means. The comparator means compares a large comparison value with a small comparison value and outputs an incrementing signal or a decrementing signal. The change means increments the global summand in response to the incrementing signal by a correction value or decrements the summand in response to the decrementing signal.

The method according to the invention compares a large comparison value with a small comparison value, with the large comparison value being formed by averaging of adaptation factors for large precontrol values, while the small comparison value is formed by averaging of adaptation factors for small precontrol values. If the large comparison value is less than the small comparison value, the summand for the additive correction of the precontrol value is incremented by a correction value, otherwise it is decremented.

This measure is based on the following realization. With a short injection time, that is, a small precontrol value, the additive error in the precontrol value would be, for example, +5% and the multiplicative error would likewise be 5%. The total error is then 10% and the adaptation factor is thus 1.1 as long as no additive correction is carried out. With an injection time five times longer, the fixed additive error is then only 1%, while the multiplicative error continues to be 5%. The total deviation is thus 6% and has as a consequence an adaptation factor of 1.06, as long as no additive correction is made. If, however, the precontrol time is corrected not only by the adaptation factor but also by a summand, the circumstances change. Let us assume that the summand is determined absolutely correctly, that is just that short period of time which is necessary for compensation of the additively acting error is added to the precontrol time. Then all that remains is the multiplicatively acting error which, in the example, leads to an error of 5%, that is an adaptation factor of 1.05, both for short injection times and for long injection times. The example illustrates the realization that a smaller adaptation factor for large injection times in comparison with the adaptation factor for short injection times is a sign that an additively acting error exists and that advantageously a summand is added to the respective precontrol time for correction.

This measure also eliminates the deficiency described above of simulated, unnecessary correction due to the effect of opposing influences. If, with a short injection time, an additively acting error of, for example +5% and a multiplicatively acting error of −5% exist this leads to an adaptation factor of 1.0 for the short injection time considered, but to a factor of 0.96 for an injection time five times longer (+1% additively, −5% multiplicatively). In this case as well, the adaptation factor for the large injection time is smaller than the adaptation factor for the short injection time, which, as explained, is the sign for the need to add a correction summand.

In the example just described to explain the principle of the invention, only one adaptation factor for a short injection time and one adaptation factor for a long injection time were assumed in the comparison. However, it is more advantageous for practical purposes to form a large comparison value by averaging from a plurality of adaptation factors for large precontrol values and correspondingly to calculate a small comparison value for small precontrol values. Then not only two adaptation factors, but the two comparison values are compared with each other by the comparator stage. Different methods are of advantage for the forming of these comparison values for different system set-ups and this is explained in more detail further below with reference to exemplary embodiments.

It is of particular advantage with respect to the oscillating stability of a system controlled by this process not to change the summand with every small deviation between large comparison value and small comparison value but only to perform a modification when a predetermined threshold value is exceeded. Minor fluctuations then do not lead to modifications of the system parameters.

It likewise contributes to stabilization against oscillation tendencies to modify the summand only by a small predetermined fixed correction value in each case, irrespective of the difference between large comparison value and small comparison value. A departure from this and use of a correction value the magnitude of which is proportional to the difference between large comparison value and small comparison value is only recommendable if the comparison values are formed by averaging from relatively many individual values, so that although a large modification of the summand quickly brings about a modification of the control parameters, this leads to weak. feedback to the comparison values.

BRIEF DESCRIPTION OF THE DRAWINGS

The invention is explained in more detail below with reference to exemplary embodiments illustrated by figures, in which.

DESCRIPTION OF THE PREFERRED EMBODIMENT OF THE INVENTION

Figure 1:
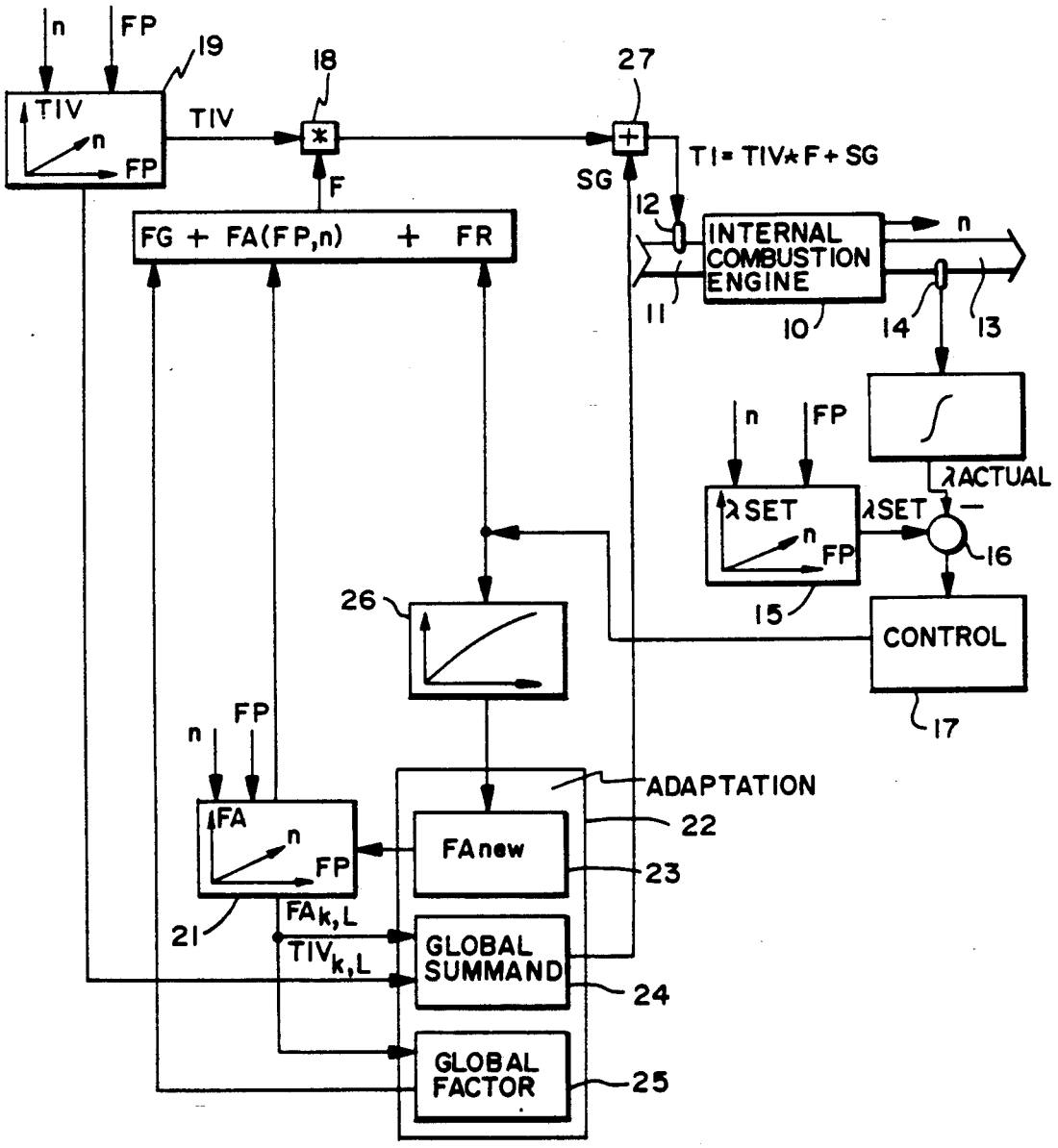
FIG. 1 shows a function diagram of a learning precontrol/control method for setting the injection time, inter alia with the aid of a global summand, represented as a block circuit diagram.
Figure 2:
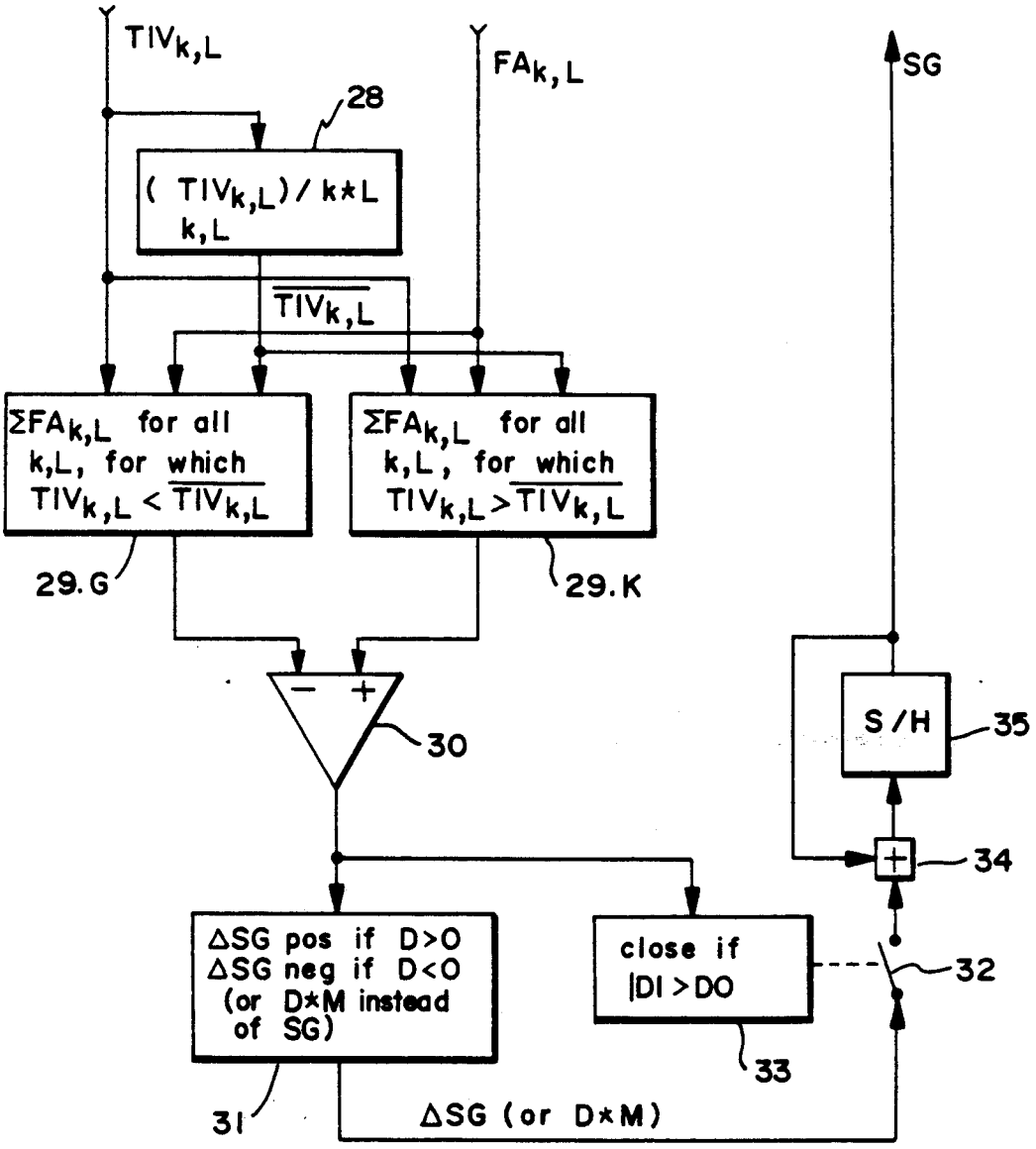
FIG. 2 shows a function diagram of the function group within FIG. 1 which determines the global summand, represented as a block circuit diagram; and, FIG. 3 shows a function diagram of a variant of a function subgroup within FIG. 2, represented as a block circuit diagram.

FIGS. 1 and 2 relate to a single exemplary embodiment with FIG. 1 giving an overall view of a precontrol/control process for setting the injection time for an injection valve of an internal combustion engine 10, while in FIG. 2 the most important function group for the invention within FIG. 1 is represented in detail.

An injection valve 12, which is actuated by a signal for the injection time TI, is arranged in the intake pipe 11 of an internal combustion engine 10. A lambda value which is measured by a lambda probe 14 arranged in the exhaust pipe 13 of the internal combustion engine 10, is established in dependence on the quantity of fuel injected and the quantity of air taken in. The measured lambda actual value is compared in a comparison step 16 with a lambda desired value supplied by desired-value generator means 15, and the system deviation value formed is supplied to control means 17 with integrating performance which outputs a control factor FR as manipulated variable. With this control factor, a precontrol time TIV for the injection time is modified by multiplication in a multiplying step 18. In the case of the exemplary embodiment shown, the precontrol time TIV is supplied by a precontrol memory 19 which stores precontrol times TIV addressable via values of the speed n and the position of an accelerator pedal FP.

The precontrol times TIV are fixed for certain operating conditions and certain system characteristics. However, the operating conditions, for example the air pressure or the system characteristics, for example leakage air characteristics or the closing time of the injection valve 12, change during the operation of the internal combustion engine. In order to obtain as good a precontrol value as possible all the time in spite of these changes, the precontrol time read out from the precontrol memory 19 is also modified with an adaptation factor FA (FP, n). This adaptation factor is read out from an adaptation factor memory 21 which has a corresponding number of support points as the precontrol memory 19 and, like the latter, can be addressed via sets of values of the speed n and the accelerator pedal position FP. For example, in each case 64 support points with k=8 addresses for classes of accelerator pedal positions FP and L=8 addresses for classes of speed values n are involved. The particular adaptation factor FA is also incorporated multiplicatively by the multiplying stage 18, as is a global factor FG. Strictly speaking, the following multiplicative correction should take place:

$$TIV \times (FG \times FA\ (FP, n) \times FR)$$

Since, however, in practice all of the correction factors deviate only a few percent from 1.0, the following value approximately corresponds to the value just mentioned:

$$TIV \times (FG + FA(FP,n) + FR) = TIV \times F$$

In the system according to the exemplary embodiment shown, the factor F formed by summation of the correction factors is multiplicatively combined with the respective precontrol time TIV in the multiplying stage 18. Instead, there could also be three multiplying stages.

Apart from the multiplicative correction, the precontrol time also undergoes an additive correction by a global summand in an adding stage 27. The injection valve 12 is thus supplied with the injection time TI, calculated as follows:

$$TI = TIV \times F + SG$$

The adaptation factors FA, the global factor FG and the global summand SG are formed in adaptation means 22 which has three function subgroups, namely an adaptation factor calculation means 23, a global summand calculation means 24 and a global factor calculation means 25. Of particular interest is the function of the global summand calculation means 24, which is explained in more detail further below with reference to FIG. 2. First, however, let us briefly look at the function of the adaptation factor calculation means 23 and of the global factor calculation means 25. The two calculation means just mentioned can operate as described, for example, in U.S. Pat. No. 4,827,937, already mentioned at the beginning. The adaptation means 22 is supplied with the control factor FR via an averaging step 26 and, from this factor, a new value is always calculated on the basis of the old adaptation factor for a support point if the values of the addressing operating variables move in a range which belongs to the support point considered in that particular case and this range is then left. After its determination, the newly determined adaptation factor is taken over into the adaptation factor memory 21 so that it is available as an improved value if an operating state with the same values of the addressing operating variables reoccurs.

At predetermined relatively large time intervals the average value is formed from all of the adaptation factors in the adaptation factor memory 21 and with this value the previously applicable global factor FG is modified. The adaptation factors of previously addressed support points are retrospectively corrected.

The adaptation factors FA and the global factor FG can, however, be obtained in any desired way. The methods according to the mentioned publication serve only as an example. They have no influence on the obtaining of the global summand SG described below.

For obtaining the global summand, the global summand calculation means 24, the function of which is represented in detail in FIG. 2, includes: an average value calculation means 28, a large comparison value means 29.G, a small comparison value means 29.K, a comparator means 30, a correction value memory 31, a change-over step 32 with switch operating means 33, a combination means step 34 and a sample/hold means (S/H) 35.

The average value calculation means 28 calculates the average value from all the precontrol times TIV, as they are stored for the $k \times L$, that is $8 \times 8$ support points of the precontrol memory 20, and divides the sum by the value $k \times L$. The average value $\overline{TIV}_{k,L}$ thus obtained serves solely to allow a distinction as to for which values of the indices k and L the precontrol times $TIV_{k,L}$ are larger than the average value and for which values of the indices the precontrol times are smaller. This information is of significance for the two comparison value means. The large comparison value means 29.G forms a sum of all the adaptation factors which are stored under the values of the support point indices k and L, for which the respective precontrol time in the same-indexed precontrol memory 20 is greater than the average value of all the precontrol times. The small comparison value means 29.K correspondingly forms the sum for all the adaptation factors $FA_{k,L}$ which belong to precontrol times which are smaller than the average value of all the precontrol times. The difference between the two sums is formed by the comparator means 30, which outputs a difference signal D. If the large comparison value supplied from the large comparison value means 29.G is larger than the small comparison value supplied by the small comparison value means 29.K, that is the difference D is negative, then the correction value memory 31 outputs a negative fixed correction value $-\Delta SG$, otherwise a fixed positive correction value $+\Delta SG$ of the same magnitude. In addition, the difference signal D is supplied to the switch operating means 33, which then carries out the change-over step 32 if the amount of the difference exceeds a threshold value $D_0$. The positive or negative correction value $\Delta SG$ is then added in the combination step 34 to the old global summand SG stored in the sample/hold means 35, whereby a new incremented or decremented global summand SG is formed. As explained further above, a difference signal D persists as long as the global summand SG acting additively on the precontrol value is not correctly determined and, as a result, the adaptation factors for large injection times deviate from those for small injection times.

Figure 3:
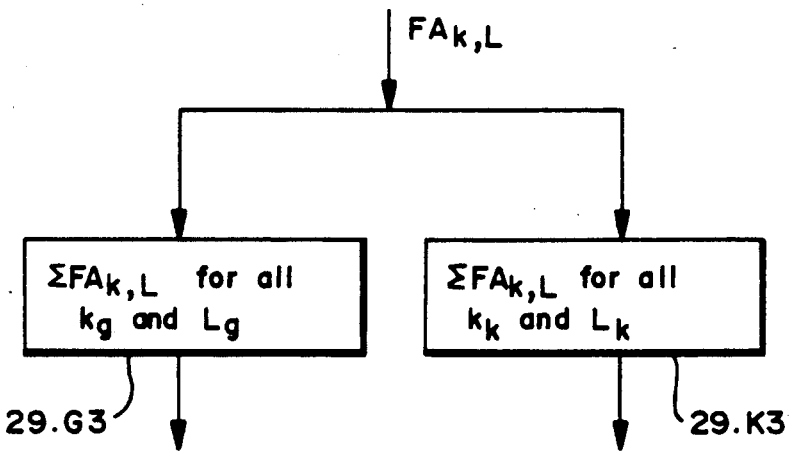

A variant of the function groups for obtaining the large comparison value and the small comparison value is represented in FIG. 3. Instead of the average value calculation means 28 and the two comparison value means 29.G and 29.K, there are now only the two comparison value means in a different operating mode, namely a large comparison value means 29.G3 and a small comparison value means 29.K3, which are supplied with the adaptation factors $FA_{k,L}$. It is stored in the comparison value means themselves for which values $k_g$ and $L_g$ of the indices k and L relatively large precontrol values apply and for which values $K_k$ and $L_k$ of the indices small precontrol values apply. For adaptation factors having the corresponding indices, the summation is performed in each case.

The method according to FIG. 2 with the average value calculation means 28 has the advantage of great flexibility, but the disadvantage of a certain computation effort. The flexibility is based on the fact that devices of the type described here are, as a rule, of microcomputer technology and that, when adapting a device to a special type of engine, essentially only the values stored in the precontrol memory 20 have to be changed. If the variant according to FIG. 3 is used, for the adaptation to a new type of engine, as a rule the values of those indices for which large precontrol times and small precontrol time then apply also have to be specified. If these values are stored, however, the system according to FIG. 3 has the advantage that there is no longer the need for the calculation effort for forming the average value of the precontrol times.

The computation effort can be further reduced the less the number of adaptation factors for which the sum is formed by the comparison value means 29.x. In the critical case, it would be adequate to compare the adaptation factor which belongs to a support point with particularly large precontrol time with an adaptation factor which belongs to a support point with particularly small precontrol time. This only works, however, in the case of a method which ensures that these support points are regularly adapted, for example by a method for adapting also remote support points or by a process which operates with a global multiplication factor. Such processes are described in U.S. Pat. No. 4,827,937, already mentioned several times. However, it is safer to form the sum of the adaptation factors over as many support points as possible.

The formation of the sum over many support points also has the advantage that a strong changing of the adaptation factor of one support point only has a relatively weak effect in percentage terms on the sum. This reduces the oscillation tendency of the system. Then the correction value can also be determined according to a variant such as that given in brackets in FIG. 2 in the symbol for the correction value memory 31, namely by the value being obtained by multiplication of the value of the difference signal D by a proportionality constant M. The global summand SG is then corrected all the more the larger the value of the difference signal D. This has the advantage that the method can respond quickly to relatively large additively acting disturbances. The disadvantage, however, is that oscillations can occur on account of the feedback. As already explained, this oscillation tendency is reduced if the feedback is designed to be weak in that a changed adaptation value only has a weak effect on the value of the difference signal.

It has already been pointed out at various points in the description that details of the exemplary embodiment are unimportant for the invention. To add to these statements, it should also be mentioned here that precontrol times TIV can also be obtained by division of the signal supplied by an air mass sensor by the speed, as is customary in commercially available devices. In this case, however, the variant according to FIG. 2 is ruled out for obtaining the comparison values, and only variants can be implemented in which it is fixed in advance for which indices of support points adaptation factors are to be summed. It should also be pointed out that the desired-value generator means 16 does not have to be designed as a characteristic field, as represented in FIG. 1, but that the desired value may also be determined differently, in particular that the single fixed lambda desired value "1" may be specified.

In the exemplary embodiment, it was mentioned as a condition for the modification of the global summand SG that the amount of the difference signal D should be larger than a threshold value $D_0$. As likewise already mentioned, this has the advantage that the global summand is not also changed immediately with every minor modification in an adaptation factor, which would increase the oscillation tendency. However, depending on the oscillation tendency of the overall system, other conditions may also by used, for example that the global summand is corrected after a fixed predetermined time or that the correction takes place after a predetermined number of corrections of adaptation factors.

All that is important for the invention is that a global summand is formed in dependence upon the difference between adaptation factors for large precontrol values and adaptation factors for small precontrol values with the summand being incremented whenever the difference is negative and decremented whenever the difference is positive.

The correction values by which the global summand is incremented or decremented may have different magnitudes. The concrete values are to the determined in such a way that an adaptation which is as fast and good as possible is produced with a low oscillation tendency.

I claim:

1. Apparatus for learning control with precontrol for setting the lambda value for the air/fuel mixture to be metered to an internal combustion engine, the apparatus comprising:

precontrol means for outputting a precontrol value for a fuel-metering operating variable in dependence upon values of operating variables;

desired-value generator means for outputting the lambda desired value;

control means for forming a control factor as a control output in dependence upon the difference between the lambda desired value and the lambda actual value measured in a particular case, with which output the particular precontrol value is corrected in a closed-loop manner by multiplication;

an adaptation factor memory for storing adaptation factors addressable by values of addressing operating variables and for outputting in each case the adaptation factor which belongs to the set of values of the addressing operating variables existing in the particular case, by which adaptation factor the precontrol value is additionally multiplied for open-loop correction;

global summand determination means for determining a summand which is added to the precontrol value corrected by the multiplicative factors;

said summand determination means including:

comparator means for comparing a large comparison value with a small comparison value with the large comparison value being formed by averaging of adaptation factors for large precontrol values and the small comparison value being formed by averaging of adaptation factors for small precontrol values;

said comparator means being adapted for outputting an incrementing signal whenever the large comparison value is less than the small comparison value and for outputting a decrementing signal in the converse case; and, modification means for incrementing the global summand by a correction value in response to the incrementing signal or for decrementing the global summand by a correction value in response to a decrementing signal.

2. In a method for learning control with precontrol for setting the lambda value for the air/fuel mixture to be metered to an internal combustion engine, with a precontrol value being corrected with the following: a control output value, adaptation factors and a global summand, the method of determining the global summands comprising the steps of:

forming a large comparison value by averaging adaptation factors for large precontrol values;

forming a small comparison value by averaging adaptation factors for small precontrol values;

comparing the large comparison value to the small comparison value; and, incrementing the global summand by a correction value whenever the large comparison value is smaller than the small comparison value, and vice versa.

3. The method of claim 2, wherein a same fixed value is sued in each case as correction value for decrementing and incrementing.

4. The method of claim 2, wherein the correction value is determined proportionally to the difference between the large comparison value and the small comparison value.

5. The method of claim 2, wherein the global summand is only modified if the amount of the difference between the large comparison value and the small comparison value exceeds a predetermined threshold value.

* * * * *

UNITED STATES PATENT AND TRADEMARK OFFICE

CERTIFICATE OF CORRECTION

PATENT NO. : 5,065,726

DATED : November 19, 1991

INVENTOR(S) : Martin Klenk

It is certified that error appears in the above-identified patent and that said Letters Patent is hereby corrected as shown below:

In column 2, line 15: delete "for" and substitute -- has -- therefor.

In column 2, line 68, after "example", insert -- , --.

In column 3, line 1, after "exist", insert -- , --.

In column 3, line 64: delete "EMBODIMENT" and substitute -- EMBODIMENTS -- therefor.

In column 8, line 58: delete "sued" and substitute -- used -- therefor.

Signed and Sealed this

Fourth Day of May, 1993

*Attest:*

Michael K. Kirk

MICHAEL K. KIRK

*Attesting Officer*

*Acting Commissioner of Patents and Trademarks*